US007121499B2

(12) United States Patent
Lammers et al.

(10) Patent No.: US 7,121,499 B2
(45) Date of Patent: Oct. 17, 2006

(54) POWERED TAPE DISPENSER

(75) Inventors: Anthony J. Lammers, Gates Mills, OH (US); John R. Nottingham, Bratenahl, OH (US); John W. Spirk, Gates Mill, OH (US); Patrick W. Brown, Auburn, OH (US); Daniel Wanhainen, Twinsburg, OH (US)

(73) Assignee: InnoDesk Business Tools, Inc., Beachwood, OH (US)

( * ) Notice: Subject to any disclaimer, the term of this patent is extended or adjusted under 35 U.S.C. 154(b) by 116 days.

(21) Appl. No.: 10/951,070

(22) Filed: Sep. 27, 2004

(65) Prior Publication Data

US 2005/0077336 A1 Apr. 14, 2005

Related U.S. Application Data

(60) Provisional application No. 60/506,242, filed on Sep. 26, 2003.

(51) Int. Cl.
*B65D 85/67* (2006.01)
*B26D 1/00* (2006.01)

(52) U.S. Cl. ..... 242/588.6; 83/13; 83/225; 83/436.1; 83/649

(58) Field of Classification Search ..... 242/588, 242/588.6, 564, 564.1, 565; 83/649, 650, 83/949, 436, 221, 225, 13; 225/10, 66, 77
See application file for complete search history.

(56) References Cited

U.S. PATENT DOCUMENTS 2,210,003 A * 8/1940 Randolph
2,326,916 A * 8/1943 Anderson
2,684,655 A * 7/1954 Kuhnle
2,800,178 A * 7/1957 Taylor
2,801,848 A * 8/1957 Taylor
2,885,902 A * 5/1959 Hackett
3,043,486 A * 7/1962 Doyle
3,465,629 A 9/1969 Krueger
3,494,235 A 2/1970 Postolowski
3,559,519 A 2/1971 Westphal et al.
3,747,816 A 7/1973 Se-Kit
3,802,309 A 4/1974 Bosland
4,220,495 A 9/1980 Uchida
4,712,460 A 12/1987 Allen et al.

(Continued)

*Primary Examiner*—William A. Rivera
(74) *Attorney, Agent, or Firm*—Keevican Weiss Bauerle & Hirsch LLC; Blynn L. Shideler

(57) ABSTRACT

A tape dispensing device is comprised of a means for rotatably supporting a roll of tape. A means for adhering to the tape and pulling the tape forwardly is positioned forwardly of the supporting means. The adhering means and pulling means is rotatably supported. A motor means is provided for imparting rotation to said adhering and pulling means. Means for cutting the tape means is positioned forwardly of said adhering and pulling means. A switch means is provided for actuating the motor continuously while said actuating means is engaged. Also a shaping means is positioned above the path of travel of the tape to urge the tape against the adhering and pulling means, the adhering and pulling means including a set of feed rollers. The shaping means is positioned between a pair of adjacent feed rollers, the lowermost edge of the shaping means being positioned below the uppermost edge of said pair of adjacent feed rollers forming a structural indentation in said tape. A handle means is formed in the housing means for gripping said housing means and directing the dispensing means to dispense tape to a selected location.

24 Claims, 6 Drawing Sheets

U.S. PATENT DOCUMENTS

| | | | |
|---|---|---|---|
| 4,817,840 | A | 4/1989 | Atkins et al. |
| 4,823,953 | A | 4/1989 | Anderson et al. |
| 4,944,441 | A | 7/1990 | Gana |
| 5,048,737 | A * | 9/1991 | Sueda et al. |
| D325,394 | S | 4/1992 | Ishii |
| 5,125,589 | A | 6/1992 | Manusch |
| 5,215,240 | A | 6/1993 | Berg et al. |
| 5,478,000 | A | 12/1995 | Jensen |
| 5,579,669 | A | 12/1996 | Kind et al. |
| 5,851,348 | A | 12/1998 | Muenzer et al. |
| 6,065,519 | A | 5/2000 | Lee |
| 6,176,409 | B1 | 1/2001 | Lee |
| D448,416 | S | 9/2001 | Kimura |
| 6,453,575 | B1 | 9/2002 | Hsieh |

* cited by examiner

POWERED TAPE DISPENSER

RELATED APPLICATIONS

This application claims the benefit of U.S. Provisional Patent Application Ser. No. 60/506,242, filed Sep. 26, 2003.

BACKGROUND OF THE INVENTION

I. Field of the Invention

The present invention relates to tape dispensing devices, and more particularly, to battery-powered devices for automatically dispensing a length of pressure-sensitive, adhesive tape.

II. Background

Tape dispensers are well known in the prior art. Very basic tape dispensers are comprised of a simple support frame for a tape roll in which the roll of tape can rotate, for pulling tape manually over a serrated cutting bar. Other devices provide mechanically-driven, ratchet-type means for dispensing tape from a roll.

Recently, motorized tape dispensers are provided for automatically dispensing tape. These devices are generally stationary, desktop-mounted devices that require the user to handle the dispensed tape to manually apply the tape to a package, envelope, or other object. Existing tape dispensing devices are typically open-cradle support frames for the tape roll, for removing or replacing the tape roll. These motorized devices are not easily portable, as they are designed to be set upon a desktop or some other stationary surface.

SUMMARY OF THE INVENTION

What is disclosed is a tape dispensing device comprising means for rotatably supporting a roll of tape, with means positioned forwardly of said supporting means for adhering to the tape and pulling the tape forwardly. The adhering means and pulling means are rotatably supported. A motor is provided for imparting rotation to said adhering and pulling means positioned rearwardly of said supporting means. A drive train comprising a plurality of gears is employed for transferring rotation from the motor to the adhering and pulling means. A cutting bar is positioned forwardly of the adhering and pulling means for cutting the tape. A switch means is used to actuate the motor continuously while the switch is engaged. A handle is attached to the tape roll support means or housing to permit the operator to direct the tape dispensing device toward a selected location.

The power transfer means includes at least one worm gear attached to the motor for changing the direction of rotation between the motor and the adhering and pulling means. The handle has a hollow interior, with the motor and at least a portion of the drive train gears disposed therein. The device is also provided with a hinged door for removal and replacement of a roll of tape, as well as for retaining a roll of tape inside the housing when the device is transported by the handle.

The tape dispenser disclosed in the present invention provides a fully-enclosable tape housing. An optional hinged, latchable closure door prevents the tape roll from falling out of the cradle when the tape dispenser is carried by the handle.

A handle feature also permits greater portability and encases the power source, drive motor, and portions of the drive train. A switch is disposed advantageously on the exterior of the handle, positioned atop the handle adjacent to the roll cradle for convenient operation by the operator's thumb.

The combination of the handle feature and the tape enclosure hinge door provides a tape dispenser that is very well suited to rough usage and dirty or harsh environments, in that the tape dispenser may be loaded with tape and easily carried and operated in any orientation without exposing the tape roll to the environment.

The tape dispenser permits the user to dispense a strip of tape, direct the tape strip toward its target, such as a package seam, apply the tape strip, and sever the tape strip from the tape roll, all of which requires the use of only one hand. This capability is especially useful for working in tight places or for applying multiple tape strips on packaging in rapid succession, and for carrying the device with the dispensing end pointed downward or upside down without fear of losing the tape roll from the cradle.

The tape dispenser further includes a shape roller that creases or shapes the tape into a V-shape or concave cross-section as it discharges from the housing. This structural concavity or crease imparts a degree of stiffness to the distal end of the tape strip, allowing it to be directed more accurately toward an object.

The tape dispenser further discloses a novel gear arrangement for a tape dispenser, by employing a worm drive to impart motion in a tandem gear arrangement, allowing the housing to be more narrow, more maneuverable, and portable, and to encase a portion of the power source and drive means within the handle portion.

Another feature of the present invention is a raised collar on the handle that borders the switch, which prevents accidental actuation of the switch from the weight of the device when it is placed face-down. The momentary-type switch also provides the capability to test the motor operation while it is still inside a package, such as a plastic clamshell package, so that consumers can ensure that the model that they purchase is operating at the time of purchase.

Other advantages and objects of the invention will be readily apparent from the detailed description as set forth below.

DETAILED DESCRIPTION OF THE INVENTION

Figure 1:
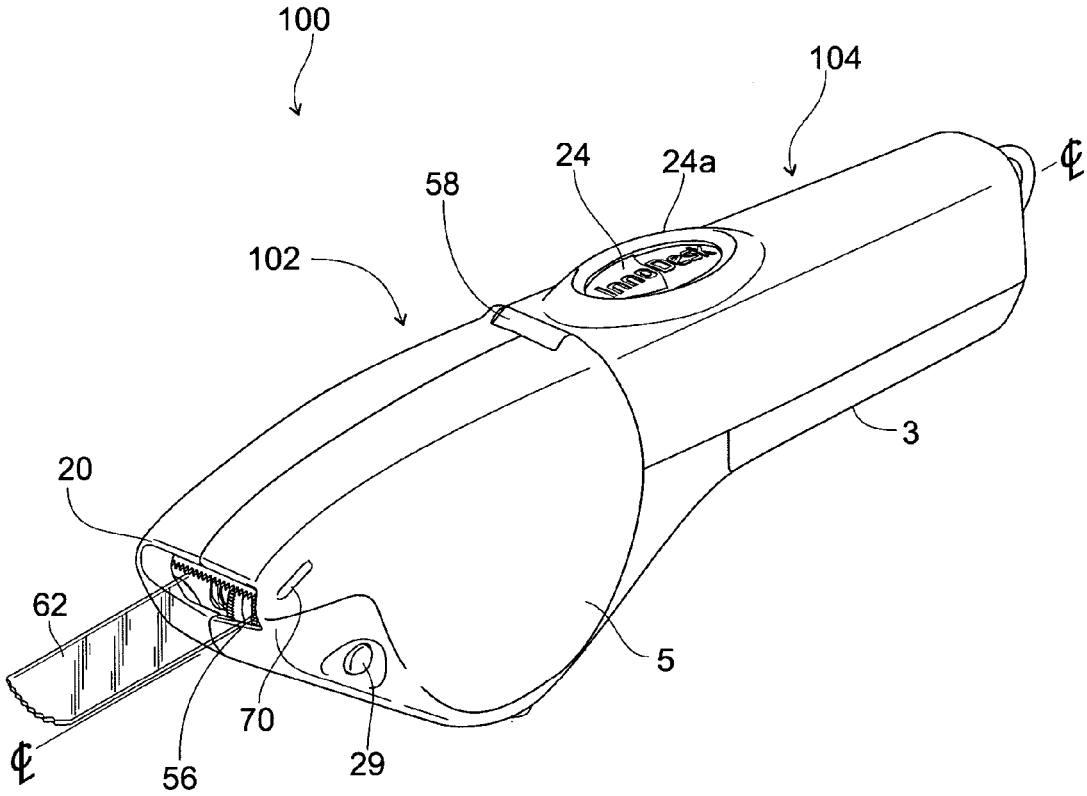
FIG. 1 is a perspective view of the powered tape dispenser.
Figure 2:
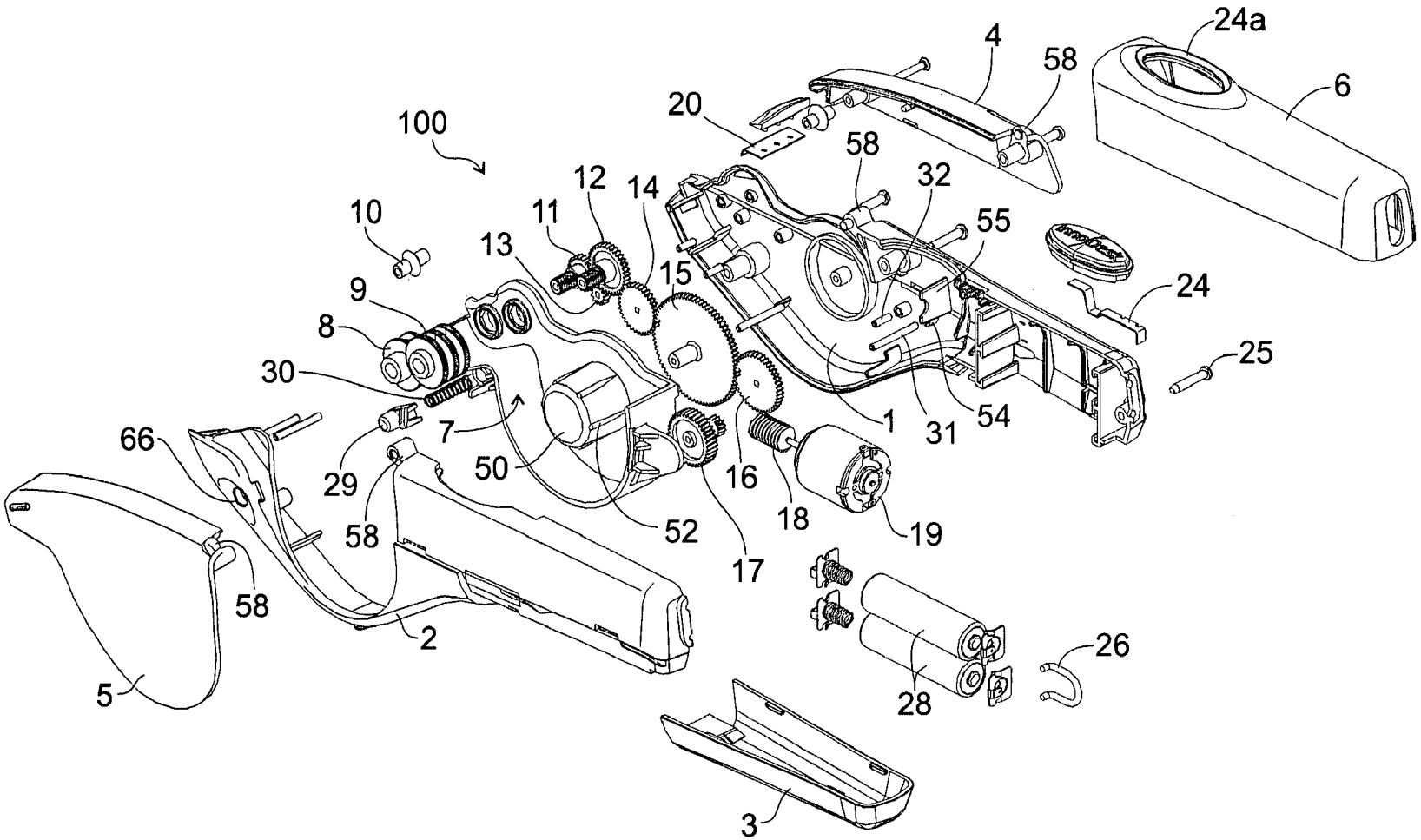
FIG. 2 is an exploded view showing the relationship and order of assembly of the various parts.

Referring first to FIG. 1, there is a tape dispensing device generally designated as 100. A first housing portion 102 contains the tape cradle door 5 and door latch release button 29, with a hollow interior for holding a roll of tape. Second housing portion 104 comprises the handle portion and includes a switch 24, a raised collar 24*a* around the periphery of the switch, and a battery chamber door 3. A discharge aperture 56 is disposed at one end of first housing portion 102, for discharging a strip of tape 62 from the tape roll disposed within the housing 102. A serrated cutting bar 20 is attached to an upper edge of aperture 56, for tearing the tape strip 62 off to the desired length.

Referring next to FIGS. 2, 3, 4, and 8, the tape dispenser for dispensing pressure-sensitive, adhesive tape includes a tape cradle 7 having a drum 50, upon which a roll of pressure-sensitive, adhesive tape 106 may be mounted. The tape roll spins free on drum 50. Drum 50 is molded into the sidewall of tape cradle 7 and remains stationary.

Motor 19 is preferably a low-voltage, DC motor energized by one or more batteries 28 or other low voltage DC power source. The device may optionally be equipped with a rechargeable power supply. Momentary contact switch 24 includes a spring-type contact 25, which completes the circuit to energize motor 19 when the switch 24 is actuated. A pushbutton-type switch is disclosed by way of example and not of limitation, and it is understood that other similar types of momentary actuation switches may be employed within the scope of the appended claims.

A worm gear 18 is attached to motor 19 driveshaft. Worm gear 18 rotates upon activation of motor 19 and meshes with drive gear 17. Drive gear 17 is a step-type gear having a large diameter portion 17*a* and a small diameter portion 17*b*. Small diameter gear drives rear idler gear 16. Drive gear 17 is mounted on shaft 31. Shaft 31 is captured and maintained in axial alignment in socket 54 adjacent to motor mounting bracket 55 on the main housing side wall 1. Rear idler gear 16 rotates to drive tape roll idler gear 15.

Use of a worm gear 18 in this manner permits a great reduction in rotational speed between the motor shaft revolutions and the drive gear, thus using fewer gears to achieve the necessary rotation of the drive gear and associated gears in the drive train. This, in turn, results in a reduced space requirement for the drive train that fits within an ergonomic handle design suitable for hand-gripping. By positioning the motor rearwardly of the cradle 7, with the motor shaft projecting toward the cradle, a narrower dimension may be achieved, thus making the handle ergonomically suited to be held in a person's hand.

After reducing the rotational speed from the motor shaft to the drive gear 17 through the worm and step gear arrangement, a series of standard spur gears is arranged to drive the feed roller 9 and guide roller 8. No particular arrangement is required; however, in the disclosed embodiment, the following arrangement is employed and described. Front idler gear 14 meshes with tape roll idler gear 15 to, in turn, drive a pair of tape guide roller gears 12, 11, connected to a set of feed rollers 9, and to a set of guide rollers 8, respectively. A guide roll idler gear 13 is disposed between roller gears 11, 12 to effect the proper rotational direction of roller gear 11 and the corresponding feed roller 9 and guide roller 8, so that both rotate in the same direction, with the guide roller 8 rotating at a slightly faster rotational speed than feed roller 9. The tape is stripped from the tape roll by feed roller 9 as the roll is rotated within the cradle, the feed roller 9 pulling tape over it and roller 8 feeding tape forward through a discharge slot 56. The gear train is designed in such a way that feed roller 9 pulls the tape from the roll, maintaining a sufficient tension on the tape strip so that it pulls away from the tape roll without breaking or binding. The peripheral speed of guide roller 8 is slightly faster, e.g., one and one half times, than the peripheral speed of feed roller 9, thus providing constant tension on the tape segment between the guide rollers. This preferred embodiment discloses one possible sequence of gears, but any number of equivalent gear sequences may be employed, the important feature being that the rotational direction of the motor shaft rotation is perpendicular to the rotational direction of the gears, thus enabling the motor to be turned such that its shaft is aligned in parallel or coaxially with the longitudinal centerline of the tape dispenser.

Feed roller 9 and guide roller 8 rotate in the same direction. Feed roller 9 and guide roller 8 each comprise a pair of adjacent stacks of circular disks evenly spaced and horizontally mounted on a shaft. Each stack is interposed or staggered to allow the adjacent stack to partially overlap with each other radially. The overlapping radii prevent tape from being drawn down and pinched into the space between feed roller 9 and guide roller 8. The peripheral surface of the disks comprising the roller stacks preferably has a corrugated, knurled, or other roughened surface to enhance the gripping for pulling tape.

Shape roller 10 is disposed adjacent guide roller 8 discharge end. Shape roller 10 partially intersects the tape discharge path as tape passes through the discharge aperture 56, thereby imparting a V or concave cross-sectional shape to the tape as it exits the discharge aperture 56. This V or concave cross-section creates a structural rigidity in the free length of tape as it is discharged. It is used to extend or dispense the tape at a predictable location and angle. The rigid length of tape thus extends outwardly for a significant length, ranging from 5 centimeters up to 1 meter and more, depending on the tape properties, before becoming slack or curling under its own weight. This rigid property of the dispensed length of tape advantageously allows the operator to direct the tape, for example, over a seam on a package or envelope with a single hand, leaving the other hand free. The V or concave shape is preferably made such that the tape does not curl back on itself and become tunneled.

A rope attachment 26 is optionally provided, preferably at the end of the handle, to provide a loop means for hanging the device on a hook or other convenient location when not in use.

After the desired length of tape is dispensed and applied to an object, the expended tape is severed from the roll by a cutting bar 20 disposed adjacent to the top edge of discharge aperture 56. Sidewalls 1,2 of housing and cap 6 form a hollow handle 104 housing the motor, worm drive, step gear, switch, and battery compartment. (The door is comprised of two door sides 4,5 forming a unitary door, which is herinafter referred to as "tape door 4,5".) Tape door 4, 5 is movably attached to the housing at sidewalls 1,2, via hinge 58, for reloading a roll of tape into the tape cradle 7. The tape roll is held in position during normal operation by tape door alignment rib 68 (shown in FIGS. 4 and 9) for the tape roll to be positioned correctly for dispensing the tape, so that the centerline of the tape roll is aligned with the centerline of shape roller 10. Tape door 4, 5 has a spring 70 exerting force on release button 29 to ensure positive closure of the door. The tape door may be opened by depressing release button 29. Cutter bar 20 and shape roller 10 are permanently attached to the tape door 4, 5, thereby requiring the lock mechanism spring 30 and release button 29 to maintain the door in a closed position when operating. Tape door 4, 5 may optionally be provided with means for grasping the door, such as finger recesses or ridges, to assist in opening the door. Ridge 70 is shown as an example in FIG. 1. Door 3 is removably attached to the housing sides 1, 2 and cap 6 for removal and replacement of batteries.

Figure 7:
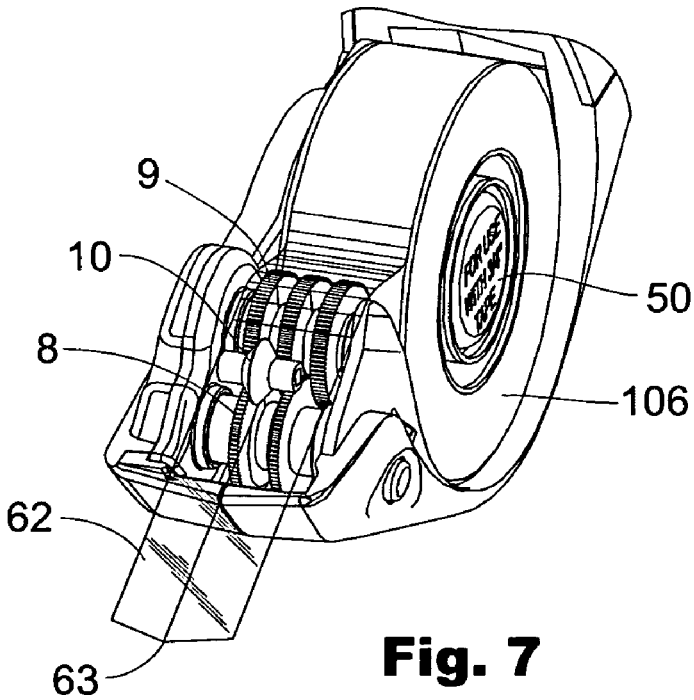
FIG. 7 is a perspective view showing the drive roller and shape roller.
Figure 8:
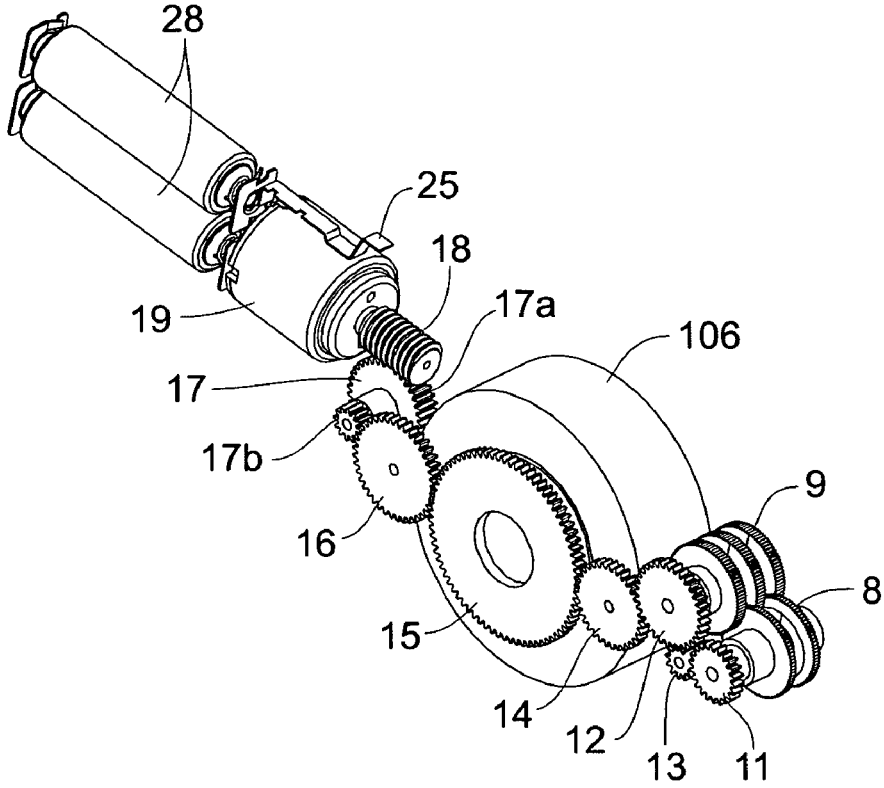
FIG. 8 is a view of the gear train, motor, and battery arrangement.

Referring to FIG. 7, a cut-away view shows the tape dispensing device with a roll of tape 106 mounted on drum 50. The tape 62 is stripped away from the roll 106, pulled over feed roller 9, then under shape roller 10, and finally over guide roller 8. A V-shaped crease 63 (as shown) or curvature is imparted to the tape strip 62 as the tape travels under shape roller 10. The shape of the crease is defined by the profile of the shape roller 10. The tape then contacts guide roller 8, which advances the tape strip 62 out of the device pointing in the direction opposite the handle (not shown).

Figure 9:
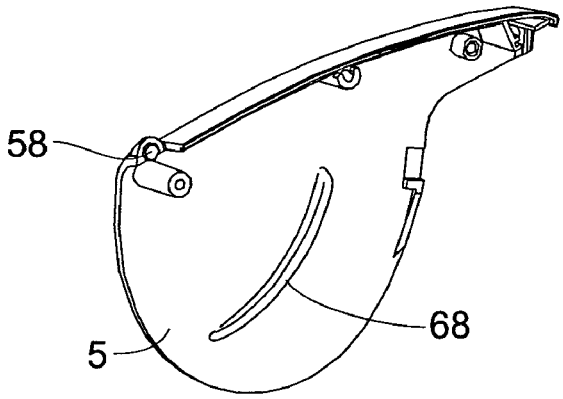
FIG. 9 is a fragmentary view of the door.

Referring now to FIG. 9, one side of door 5 is shown in perspective in a sectional view, indicating the side that covers the tape roll cradle (not shown). Rib 68 maintains the lateral alignment of the tape roll within the tape dispensing device. Hinge 58 is the point of rotation of the door for opening and closing the door.

Figure 3:
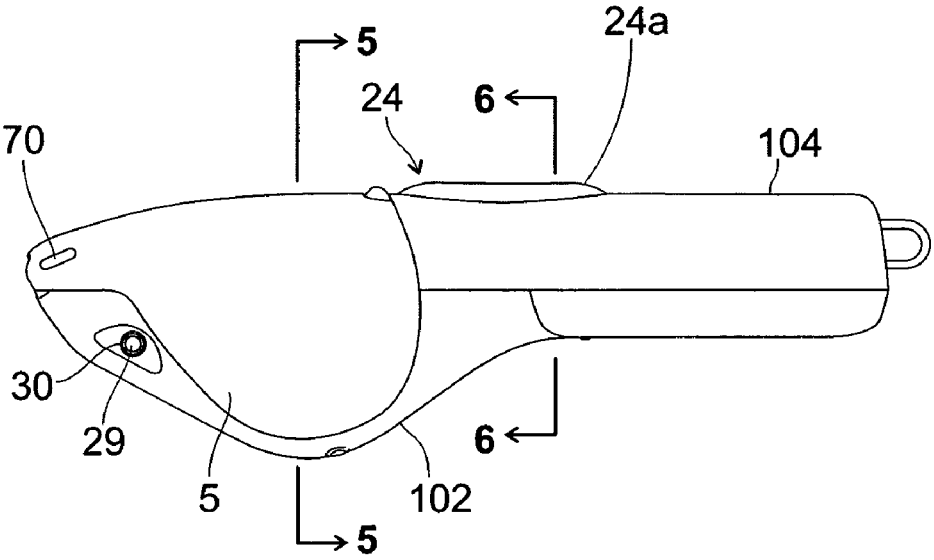
FIG. 3 is a right side elevational view thereof.
Figure 4:
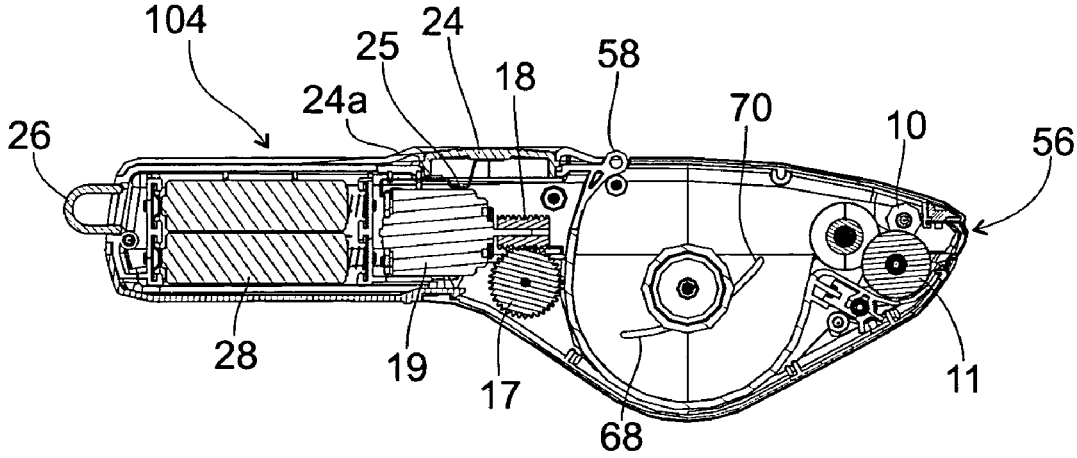
FIG. 4 is a sectional view taken along the lines 4—4 in FIG. 6.
Figure 5:
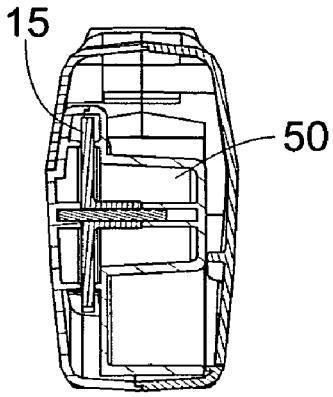
FIG. 5 is a sectional view taken along the lines 5—5 in FIG. 3.
Figure 6:
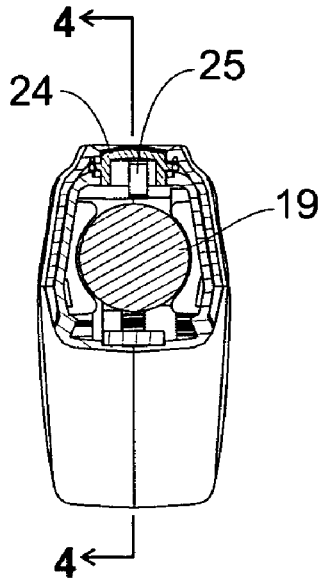
FIG. 6 is a sectional view taken along the lines 6—6 in FIG. 3.

As is apparent in FIG. 3, a handle portion 104 is formed to the rear of the belly-shaped housing 102. Handle portion is easily gripped in one hand and the switch 24 operable by the thumb of the same hand. By depressing the switch 24 with one's thumb, tape is pulled over the guide rollers from the tape roll and dispensed in the manner described above.

The belly-shaped housing 102 and door 3 may be provided with a flattened bottom portion (not shown) for a free-standing housing that will stand upright on a desktop or table top.

The housing parts are preferably comprised of ABS plastic material, with the gear and linkage material being comprised of nylon/acetyl. The device may be adapted for a variety of tape roll sizes and widths, including pressure-sensitive, adhesive tape commonly found in office supply stores, and various core inside diameters.

Optionally, a movable cutting bar may be provided to cut the tape automatically to the desired length, and may be adapted to cut the tape upon release of the power switch, or activated by an additional position on the thumb switch. Yet another option may be for a cutting bar to activate cyclically, to cut a uniform length of tape for each operation of the pushbutton switch. A dial setting may be adapted for varying the length of tape that corresponds with one cycle of the dispenser switch.

Figure 10:
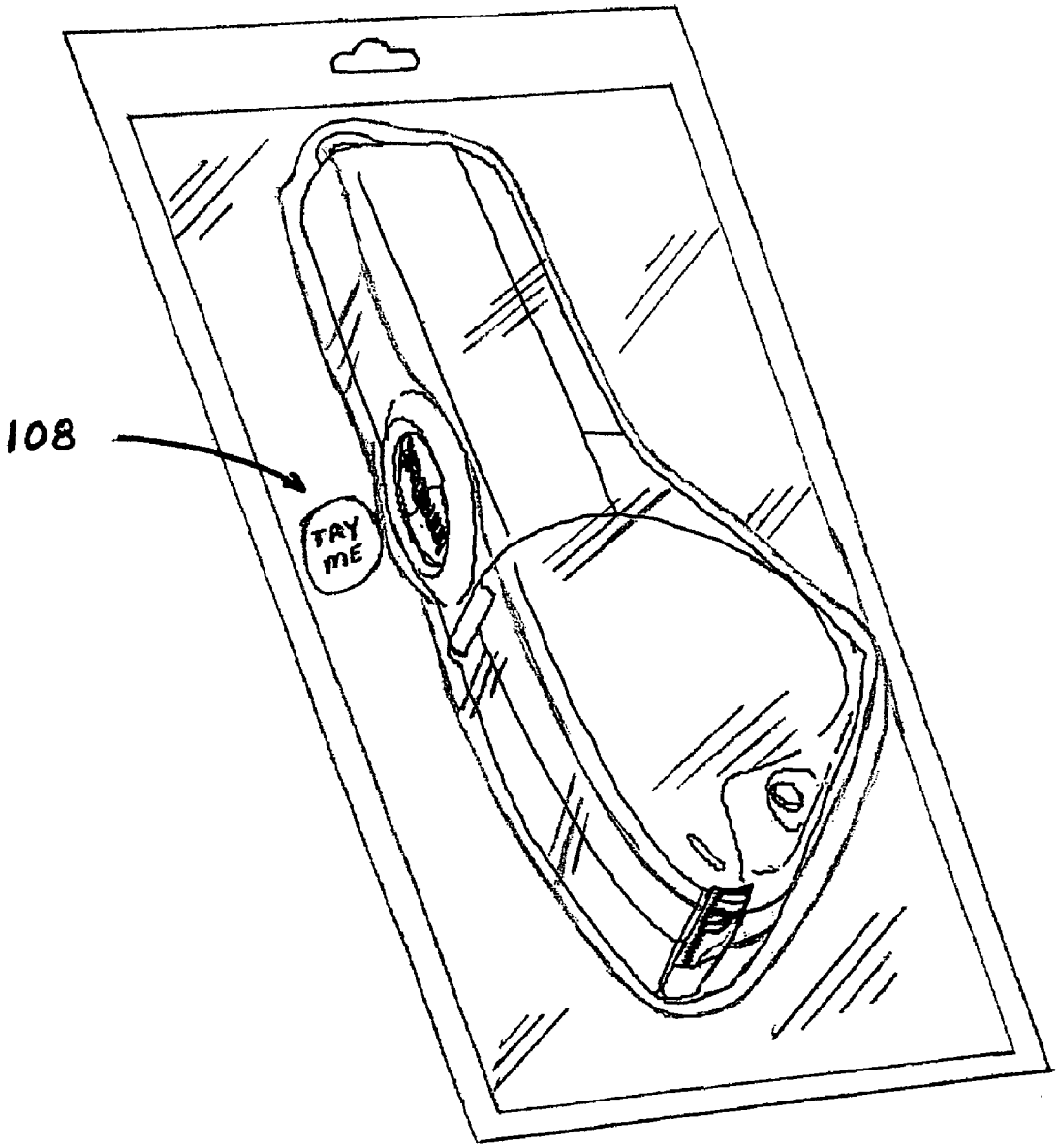
FIG. 10 is a view of the device in a packaging shell.

Referring to FIG. 10, the device of the present invention may optionally be provided in a clear plastic blister-package enclosure for shipping and storage. The blister package preferably includes a test feature 108 to operate the device while in the package, so that purchasers may demonstrate the device prior to purchasing it.

Although the invention has been described above by reference to an embodiment of the invention, the invention is not limited to the embodiment described above. Modifications and variations of the embodiment described above will occur to those skilled in the art, in light of the above teachings without departing from the spirit of the invention. It is the invention, therefore, to be limited only as indicated by the scope of the claims appended hereto.

We claim:

1. A tape dispensing device comprising:

means for rotatably supporting a roll of tape;

means positioned forwardly of said supporting means for adhering to the tape and pulling the tape forwardly, said adhering means and pulling means being rotatably supported;

motor means for imparting rotation to said adhering and pulling means positioned rearwardly of said supporting means;

means for transferring rotation from said motor means to said adhering and pulling means;

means positioned forwardly of said adhering and pulling means for cutting the tape;

means for actuating said motor means continuously while said actuating means is engaged; and handle means for gripping said housing means and directing the dispensing means to dispense tape to a selected location.

2. The tape dispensing device as set forth in claim 1, wherein said power transfer means includes at least one worm gear attached to said motor means for changing the direction of rotation between the motor and the adhering and pulling means.

3. The tape dispensing device as set forth in claim 2, wherein said handle means having a hollow interior, and said motor means and at least a portion of said power transfer means being disposed therein.

4. The tape dispensing device as set forth in claim 3, wherein also comprising a hinged door for removal and replacement of a roll of tape.

5. The tape dispensing device as set forth in claim 4, wherein also including one or more shaping means disposed adjacent to said adhering and pulling means to urge the tape against said adhering and pulling means, said adhering and pulling means including a set of feed rollers, said shaping means being positioned between a pair of adjacent feed roller disks, the lowermost edge of said shaping means being positioned below the uppermost edge of said pair of adjacent feed roller disks forming a structural indentation in said tape.

6. The tape dispensing device as set forth in claim 5, wherein said actuating means being disposed on one side of said handle means, and said actuating means comprising a manually-operated, momentary-contact switch for thumb operation.

7. The tape dispensing device as set forth in claim 6, wherein said handle means having a raised collar around at least a portion of said manually-operated, momentary-contact switch for preventing inadvertent actuation of said manually-operated, momentary-contact switch.

8. The tape dispensing device as set forth in claim 7, wherein said handle means also includes a cord portion extending therefrom forming an approximately semicircular loop for hanging the device.

9. The tape dispensing device as set forth in claim 4, wherein said hinged door includes a latching portion for latching the door in the closed position, and a release means for releasing the latching portion to allow said door hinge to open.

10. The tape dispensing device as set forth in claim 9, wherein also comprising a resilient clear shell in which said tape dispensing device is packaged, said shell being sufficiently resilient to permit actuation of said actuating means when disposed inside the shell.

11. The tape dispensing device as set forth in claim 1, wherein said tape dispensing device also comprising a flattened bottom portion for supporting the device upright on a flat surface.

12. The tape dispensing device as set forth in claim 11, wherein also comprising an integral DC power source for energizing said motor means.

13. A tape dispensing device comprising:

a housing portion including a roll drum, a cradle portion, and a hollow handle portion, said roll drum positioned within said cradle portion for rotatably supporting a roll of tape;

a set of guide rollers and a set of feed rollers rotatably supported adjacent to each other and positioned forwardly of said housing portion for adhering to the tape and pulling the tape forwardly;

a motor for imparting rotation to said pair of guide rollers, said motor being positioned rearwardly of said cradle portion and within said handle portion;

a plurality of gears in communication with said motor and said pair of guide rollers for transferring rotation therebetween;

a serrated cutting bar disposed forwardly of said guide rollers; and a switch portion for actuating said motor continuously while said switch is engaged.

14. The tape dispensing device as set forth in claim 13, wherein said plurality of gears includes at least one worm gear attached to said motor for changing the direction of rotation between the motor and said pair of guide rollers.

15. The tape dispensing device as set forth in claim 14, wherein said motor and said handle portion are axially aligned in the same direction, and said pair of guide rollers and plurality of gears rotate about an axis perpendicular to that of the motor.

16. The tape dispensing device as set forth in claim 15, wherein said housing portion also including a hinged door for removal and replacement of a roll of tape.

17. The tape dispensing device as set forth in claim 16, wherein also including one or more shape rollers disposed adjacent to said set of feed rollers for urging tape into contact with said set of feed rollers, said shape roller being disposed between one or more disk portions comprising said set of feed rollers, the lowermost edge of said shaping means being positioned below the uppermost edge of said one or more disk portions forming a structural indentation in said tape.

18. The tape dispensing device as set forth in claim 17, wherein said switch portion being disposed on one side of said handle portion, and said switch comprises a manually-operated, momentary-contact switch for thumb operation.

19. The tape dispensing device as set forth in claim 18, wherein said handle portion having a raised collar around at least a portion of said switch for preventing inadvertent actuation of said manually-operated, momentary-contact switch.

20. The tape dispensing device as set forth in claim 19, wherein said handle portion also including a cord portion extending therefrom forming an approximately semicircular loop for hanging the device.

21. The tape dispensing device as set forth in claim 16, wherein said hinged door includes a latching portion for latching the door in the closed position, and a release means for releasing the latching portion to allow said door hinge to open.

22. The tape dispensing device as set forth in claim 21, wherein also comprising a resilient clear shell in which said tape dispensing device is packaged, said shell being sufficiently resilient to permit actuation of said actuating means when disposed inside the shell.

23. The tape dispensing device as set forth in claim 13, wherein said tape dispensing device also comprising a flattened bottom portion for supporting the device upright on a flat surface.

24. The tape dispensing device as set forth in claim 23, wherein also comprising an integral DC power source for energizing said motor means.

* * * * *